US006994771B1

(12) United States Patent
Korhonen et al.

(10) Patent No.: US 6,994,771 B1
(45) Date of Patent: Feb. 7, 2006

(54) METHOD AND APPARATUS FOR HANDLING A PAPER OR BOARD WEB

(75) Inventors: Hannu Korhonen, Jyväskylä (FI); Rauno Rantanen, Muurame (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/936,279

(22) PCT Filed: Mar. 10, 2000

(86) PCT No.: PCT/FI00/00190

§ 371 (c)(1),
(2), (4) Date: Jan. 17, 2002

(87) PCT Pub. No.: WO00/55423

PCT Pub. Date: Sep. 21, 2000

(30) Foreign Application Priority Data

Mar. 12, 1999 (FI) ..... 990557

(51) Int. Cl.
*D21F 11/00* (2006.01)

(52) U.S. Cl. ..... 162/202; 162/204; 162/205; 162/305; 162/306; 162/359; 162/358.3; 162/360.2

(58) Field of Classification Search ..... 162/202, 162/204, 205, 305, 306, 359, 358.3, 360.2
See application file for complete search history.

(56) References Cited

U.S. PATENT DOCUMENTS

| | | | | |
|---|---|---|---|---|
| 4,793,899 | A | 12/1988 | Skaugen | 162/381 |
| 4,931,143 | A * | 6/1990 | Karvinen et al. | 162/360.2 |
| 5,256,257 | A * | 10/1993 | Schiel | 162/360.3 |
| 5,575,891 | A | 11/1996 | Trokhan et al. | 102/111 |

FOREIGN PATENT DOCUMENTS

| | | |
|---|---|---|
| EP | 0 881 329 A2 | 12/1998 |
| GB | 459125 | 12/1936 |

* cited by examiner

*Primary Examiner*—Mark Halpern
(74) *Attorney, Agent, or Firm*—Cohen, Pontani, Lieberman & Pavane

(57) ABSTRACT

A method for treating a web of paper or board with a wetting substance or calendering the web prior to the cylinder dryer section of a paper- or boardmaking machine while the solids content of the web is still very low, typically in the range of 10–60%, wherein the web can be conveyed when so desired fully supported from the wire section of the paper- or boardmaking machine up to the winder, while simultaneously utilizing the quality benefits obtained from a controlled reduction of the web moisture content and dewatering of the same. The web is conveyed supported by a transfer belt (9) through at least one web surface treatment apparatus such as a coater station (S1B) or a calender prior to passing the web to the first dryer cylinder group (1) of the paper- or boardmaking machine. One nip (11, 13) supported by a transfer belt (9) is suitable for dewatering simultaneously with the application of a treatment substance to the web. The dewatering nip (11, 13) may be formed between a transfer belt (9) and the wire (2) of the wire section or the felt (14) of the press section.

86 Claims, 7 Drawing Sheets

METHOD AND APPARATUS FOR HANDLING A PAPER OR BOARD WEB

This application is 371 of PCT/FI00/00190 filed 10 Mar. 2000.

FIELD OF THE INVENTION

The present invention relates to a method and apparatus for coating webs of paper and board or for surface sizing the same in order to improve their printability, strength or other qualities.

BACKGROUND OF THE INVENTION

In order to improve the qualities of a paper or board sheet, the base web of the paper or board sheet is treated in different ways. The goal of each treatment is to improve the strength or printability properties of the produced grade. Strength improvement is principally accomplished by way of surface sizing, wherein the web surface is coated with a strength-improving sizing agent such as a starch solution. Coating is applied, among other reasons, for such purposes as better product brightness, surface impermeability or smoothness, while calendering serves to improve the surface smoothness and gloss.

Conventionally, web treatment is performed after base web formation so that a dry web is treated in separate off-line equipment or, alternatively, in online equipment connected directly after the paper- or boardmaking machine. Herein, the web is dried at least essentially close to its final degree of moisture content, whereby the web must be moistened and redryed particularly during surface sizing and coating, which increases the machine length and energy consumption. As modern paper/boardmaking machines are already equipped with efficient dewatering and drying sections, it would be advantageous to have the web-wetting operations such as surface sizing and coating moved as close as possible to the headbox so as to take place within the wire section or press section, whereby the dewatering and drying of the base sheet having the surface treatment agent applied thereto can be accomplished at least partially simultaneously. Surface sizing and coating performed at the press or wire section would also offer substantial quality benefits inasmuch the penetration of the surface sizing agent into the web takes place in a manner entirely different from that when the treatment agent causing web wetting is applied to an already dried base sheet. The quality of calendering is improved if this step is carried out on a web of higher moisture content, whereby also the outcome of calendering for the most common paper and board grades would benefit from being performed at the press section of a paper/boardmaking machine.

The history of having the base sheet formation and finishing phases chained in two separate steps can be traced to two major factors. Firstly, the formation of the base sheet and its subsequent finishing have traditionally been considered extremely autonomous production phases to be implemented independently from each other. Secondly, paper webs in particular and even board webs are very fragile prior to their drying close to the final solids content, whereby it has not been possible to execute such treatments that cause wetting of the web without jeopardizing web runnability.

From the art is known an embodiment in which surface sizing is carried out using a film-transfer applicator. In a film-transfer application apparatus, a coating film metered very accurately on a rotating film-transfer roll is transferred from the roll to the surface of the running web. Although a film-transfer applicator offers very good runnability and causes a minimal stress on the web, the water permeating the web anyhow weakens its strength. Since the web will not be passed directly from the film-transfer roll onto a supporting element such as a wire, an unsupported gap remains between the film-transfer roll and the subsequent supporting element. Hence, the web is always subjected to stresses in the cross-machine direction and particularly in the machine direction. For instance, variations in the moisture content profile may cause stress peaks on the web that readily break the wet and fragile web.

In addition to the technique of film-transfer application, use of spray application has been proposed in the art, wherein the surface size or coating mix is applied to the web by means of an array of spraying nozzles staggered in the cross-machine and/or the machine direction.

In U.S. Pat. No. 3,146,159 is described an embodiment in which application is performed on a wet web by coating one side of the web and simultaneously supporting the web during application from its other side by a fabric. Coating on a calibrating press is also described.

U.S. Pat. No. 4,793,899 describes spray-coating and short-dwell application techniques, wherein the web support arrangement is more advanced than that of the above-cited patent, however, not even this embodiment is free from unsupported web travel passages and the applicator still has a web-supporting fabric therein.

U.S. Pat. No. 5,152,872, there is described an embodiment free from unsupported web travel passages. In this arrangement, the coating mix is first metered on the outer surfaces of rolls and therefrom directly to the web, yet having a felt running in the nip.

SUMMARY OF THE INVENTION

It is an object of the present invention to provide a method suited for treating a paper or board web with a wetting substance or, alternatively, calendering the web prior to the cylinder dryer section of a paper- or boardmaking machine meanwhile the solids content of the web is still very low, typically 10–60%.

It is a further object of the invention to provide a method in which the web can be passed fully supported from the wire section of the paper- or boardmaking machine, when desired, up to the winder, thus utilizing the quality improvement benefits offered by a controlled management of web moisture content and wetting.

The goal of the invention is achieved by way of passing the web supported by a transfer belt through at least one surface treatment section such as a coater station or a calender prior to taking the web to the first dryer cylinder group of the paper- or boardmaking machine.

According to one advantageous embodiment of the invention, at least one nip supported by the web-transferring belt is used for dewatering simultaneously with the application of a web treatment agent to the web. The dewatering nip may be formed between a transfer belt and the wire of the wire section or the felt of the press section of the machine. As a matter of convenience, dewatering in a nip between the transfer belt and the wire is defined to comprise a portion of the press section, whereby reference to a nip of the press section in the following text may also be understood to include a nip formed between a wire and a web transfer belt.

The invention offers significant benefits.

One of the most important benefits of the invention is that the invention allows a coated or surface-sized board or paper to be manufactured in a machine of vastly simplified or shorter construction over those known in the prior art, because the web surface treatment and drying steps can be carried out in a single or almost single space and with the same equipment that in the prior art served for dewatering on the press section and the dryer. Accordingly, the machinery is principally comprised of existing sections. If the machinery is equipped with a calender section, it may be located at the most advantageous point along the line in respect to the web moisture content and treatability of the paper grade being manufactured. The efficiency of the web drying process is improved, because drying can be performed only once without the need for rewetting an already dried web. Water removal is also performed more cost-effectively from a very wet web than from a dry web. If the surface sizing or coating application step is carried out, e.g., in the press section nip so that the web is supported from the side to be treated by the transfer belt and from the other side by a felt or wire, water is removed from the web toward the felt or the wire, thus allowing the treatment substance to penetrate into the web. In the best case, the entire volume of water corresponding to that of the treatment substance is subsided from the wet web into the felt, whereby the drying capacity needed for web dewatering is not increased. In this manner, the invention can provide so good a web surface smoothness that soft-calendered qualities of paper or board can be made with an acceptable quality. Water transport and removal as well as the calendering effect may be augmented by heating the web transfer belt or its support roll. By means of a heated belt, it is possible to control the temperature profile of the web, whereby the moisture content or smoothness profile of the web, for instance, may be varied. Additionally, the adjustment of the size metering can be used for controlling the moisture content profile.

The support belt helps to form a tapering nip between the belt and the web, thus allowing a large amount of surface size to be applied which is advantageous particularly in the manufacture of boxboard. Particularly a shoe press is capable of providing an excellent penetration in the web. Typically a shoe press is also suitable for use in the manufacture of grades having a high bulk and/or improved strength of the paper or board web. By way of applying the surface size on a wet paper or board, the number of hydrogen bonds that principally determine the web strength is increased. Also the swelling of fibers that occurs during the wetting of a dry web is eliminated, whereby the web surface quality is improved. The method according to the invention is suitable for making a great number of paper or board grades with a competitive-edge quality or for producing a base paper of excellent finish for conversion into high-quality coated grades.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention will be examined in greater detail by making reference to the appended drawings in which.

DETAILED DESCRIPTION OF THE PRESENTLY PREFERRED EMBODIMENTS

In the following description, a surface sizing process adapted to operate in different manners in conjunction with the press section of a papermaking machine is elaborated by way of example. Obviously, the same or essentially similar embodiments can be used in a boardmaking machine and others serving to apply a coating or other treatment substance on the surface of a web.

Figure 1:
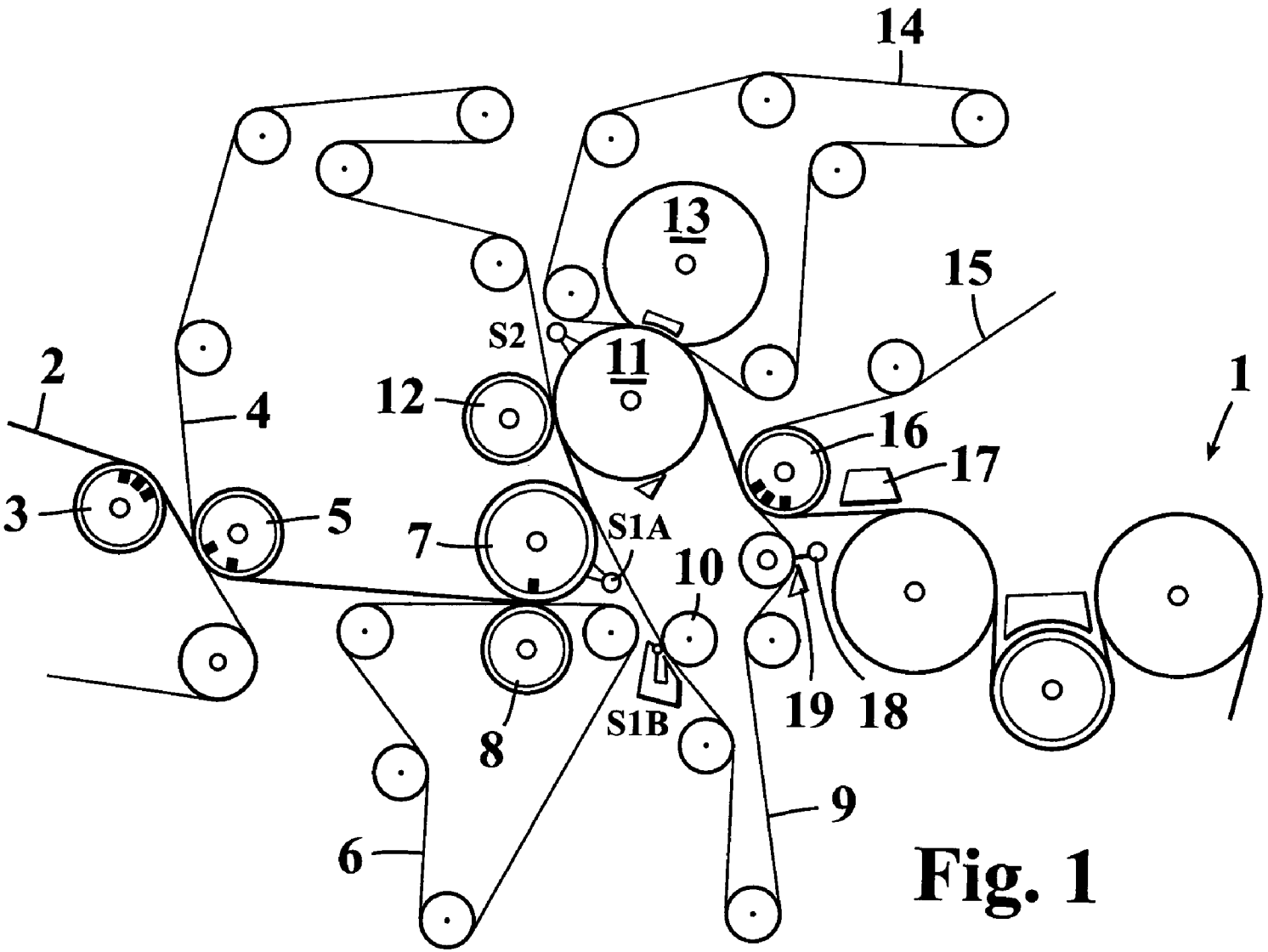
FIG. 1 shows schematically a first embodiment of the invention.
Figure 2:
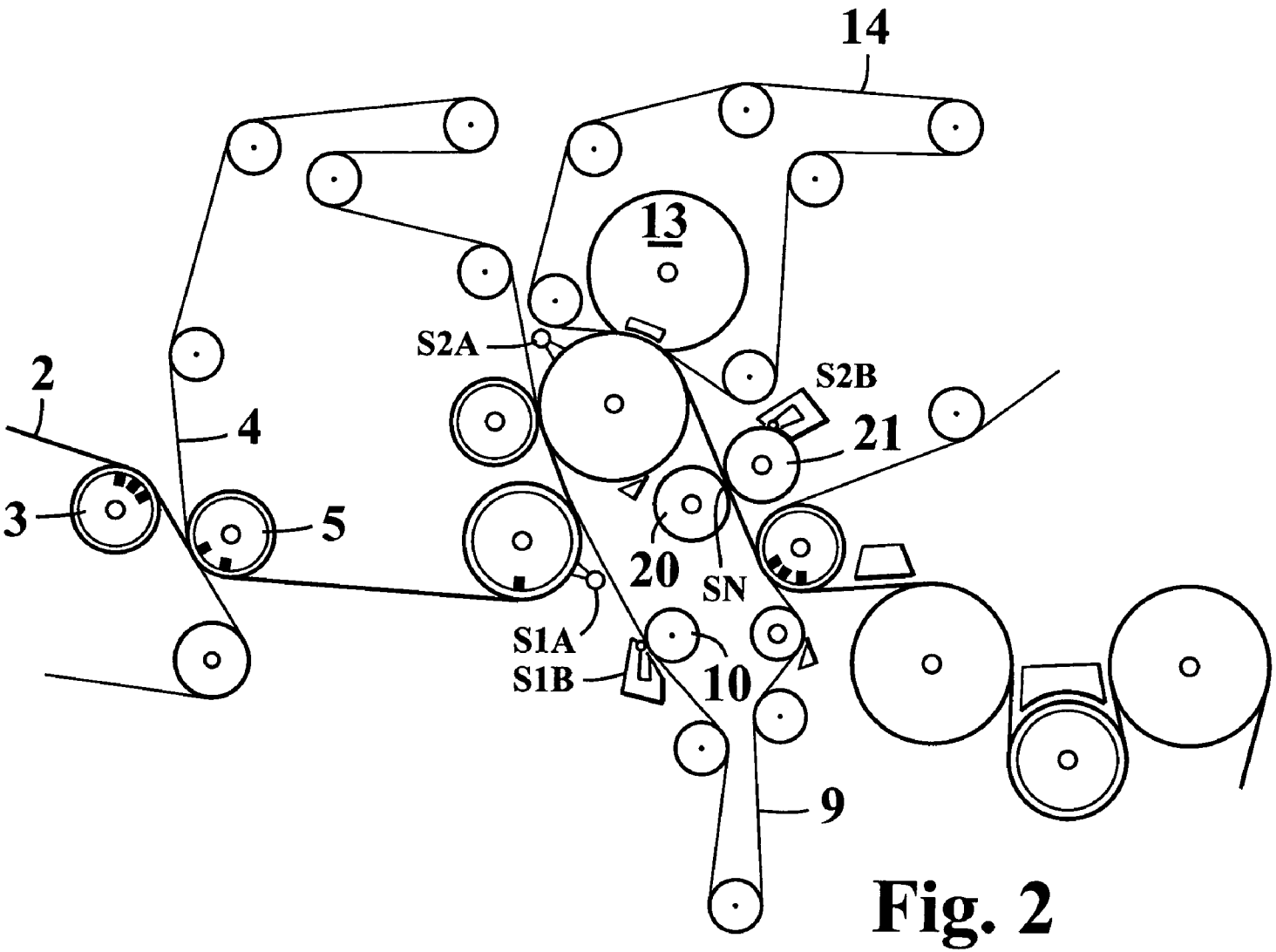
FIG. 2 shows schematically a second embodiment of the invention.

The embodiments shown in FIGS. 1 and 2 are particularly suited for being adapted into a part of the dryer section of a paper- or boardmaking machine when the machine is being rebuilt. In the illustrated embodiment, a coater or surface sizing station is located immediately prior to a dryer cylinder group 1, thus forming an integral part of the press section in the papermaking machine. As the described embodiments are primarily intended to be adapted into the press section during the rebuilding of a papermaking machine, the apparatus will form a part of the press section in the machine. In the embodiment shown in FIG. 1, the web being processed is passed on a felt or wire 2 to the surface sizing/press station. The support element, on which the web is transferred, may be the web-forming wire of the machine or, if the web has already in the preceding steps been dewatered in a press nip, the press felt. The adherence of the web to the support element surface is assured by means of a suction roll 3. From the suction roll, the web is passed to the next support element which is a felt 4. The web transfer from the delivering support element 2 onto the first felt 4 takes place with the help of a suction roll 5. The suction roll 5 presses the first felt 4 against the support element 2, and the vacuum imposed by the roll 5 adheres the web to the felt. The first felt 4 transports the web to a first dewatering nip formed between the first felt 4, a second felt 6, a second suction roll 7 and a backing roll 8. The second suction roll 7 adheres the web to the first felt 4 and, as a result, the web passes over the suction roll 7 supported by the felt 4. Into this station is also positioned a spray applicator S1A for spraying the surface size on the outwardly oriented surface of the web. Next, the web is passed into a nip formed between the transfer belt 9 and the first felt 4 at a point approximately coincident with the leaving point of the first felt 4 from the perimeter of the second suction roll 7. The transfer belt 9 is a smooth-surface belt made from a metal, advantageously steel, or from a reinforced/nonreinforced rubber or polymer material. A metal belt can be surfaced with a suitable material such as a ceramic coating, for instance. Also polymeric belts may be covered with a ceramic coating, and they may have a fabric-reinforced backing. The transfer belt 9 moves supported by guide rolls and, in the travel direction of the belt, over a backing roll 10 that is mounted in front of the nip between the first felt 4 and the transfer belt 9. At the backing roll 10, there is adapted an applicator device SIB for spreading the surface size on the belt 9. Advantageously, the applicator device SIB is of the same type used as the applicator unit of film-transfer coaters, whereby the surface size is metered and the size is smoothed on the belt surface by means of a rod or blade.

As is shown in FIG. 1, the applicator devices S1A and S1B can be used alternatively or even simultaneously when a large amount of surface size has to be applied to the same surface of the web. Next, the transfer belt 9 with the web travelling thereon is passed into a nip between a deflecting backing roll 11 and a press roll 12, wherein water is removed from the web toward the first felt 4. The transfer belt 9 with the web running thereon passes over the deflecting backing roll 11. In the illustrated embodiment, a shoe press 13 operating against the deflecting backing roll 11 over which a belt or the felt 14 passes. In order to apply surface size to the untreated side of the web, this embodiment has a spray applicator S2 adapted at a point along the web passage between the nip of the press roll 12 and its backing roll 11 and the nip between the shoe press 13 and its backing roll 11. In this arrangement, the first coated side of the web will face the belt 14 that runs over the shoe press 13. If the nip of the shoe press is adapted to have a transfer belt on both sides thereof, no dewatering takes place in the nip, but rather, the press acts as a calender that smooths the web surface.

From the shoe press 13, the web travels on the transfer belt 9 out from the shoe press nip. The web is picked from the transfer belt 9 onto the dryer wire 15 of the dryer cylinder group by a third suction roll 16. Adherence of the web to the felt is secured by means of a suction box 17, and the final drying of the web is carried out by means a dryer cylinder group 1, whereupon the web is wound into machine rolls or, altenatively, is taken to further processing at finishing equipment connected to the paper- or boardmaking machine. After the web has left the transfer belt 9, the belt can be cleaned if necessary with the help of water jets 18 and a scraper 19.

In the embodiment shown in the diagram, if the press nip is adapted to operate in conjunction with the wire section, the felt 4 is replaced by a transfer belt, and the roll 5 has no suction facility but instead is advantageously adapted to operate with a backing roll. The coating is metered with the help of a spray applicator in front of the ingoin ide of the nip formed between the roll 5 and its backing roll. In slow machines, the web can be passed directly after the press nip between the rolls 7 and 8 to the cylinder dryer section. In this case, the roll 7 is advantageously a shoe roll, while the roll 8 can be a suction roll.

The embodiment shown in FIG. 2 is otherwise similar to that of FIG. 1 with the exception of having the first dewatering nip and felt removed, while a calibrating press is added. In this embodiment, the spray applicators S1A and S1B may be used alternatively or complementary to each other, and the surface size is applied to the first side of the web by means of an applicator device adapted to operate in conjunction with the transfer belt 9. As a result, the shoe press 13 can be operated with a felt, thus permitting effective water removal toward the uncoated side of the web, whereby the above-mentioned features of good dewatering from the web and size penetration therein are attained. The calibrating press SN is located downstream from the shoe press and comprises two rolls 20, 21 forming a nip therebetween through which the web and its transfer belt 9 pass. The first roll 20 is situated on the interior side of the endless loop of the transfer belt, while the second roll 21 is on its exterior side. An applicator device S2B is adapted to cooperate with the roll 21 located on the exterior side of the endless transfer belt, whereby the roll 21 performs as a film-transfer coater in cooperation with the applicator device S2B. In addition to carrying out the surface sizing, the calibrating press helps to improve the web smoothness in a conventional manner. The calibrating press used in this and other embodiments according to the invention described herein may be replaced by a calender proper, whereby generally two pairs of rolls are needed if the calender rolls comprise a heated hard roll and a soft-covered roll, for instance.

Figure 3:
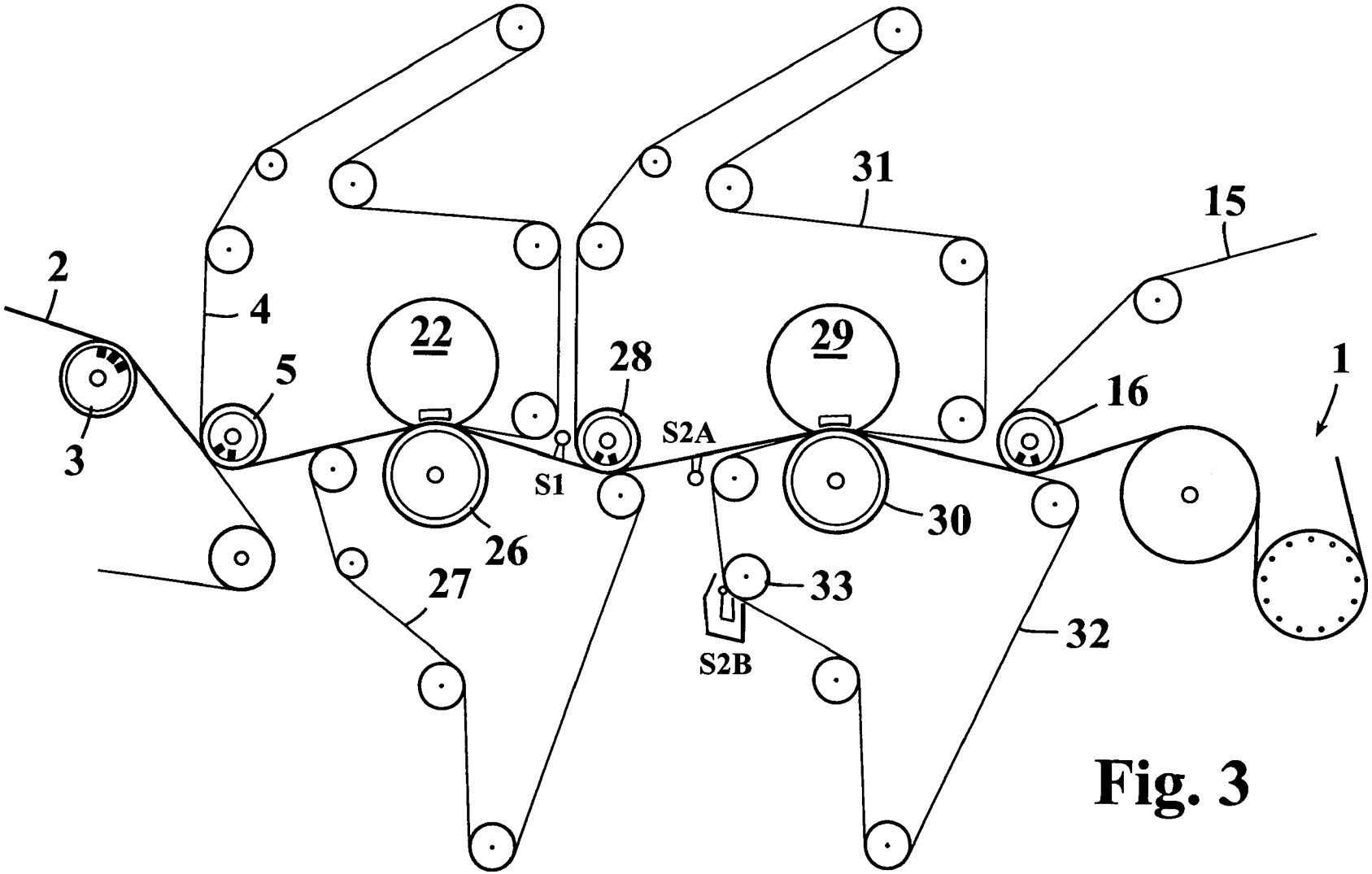
FIG. 3 shows schematically a third embodiment of the invention.

In FIG. 3 is shown an apparatus layout comprising two shoe presses. This embodiment may also be implemented using roll presses instead of shoe presses. As above, the web is again received from the preceding treatment section onto a wire 2 and then passed over a first suction roll 5 to a first felt 4. The first felt 4 travels via a first shoe press 22. The shoe press 22 is situated on the interior side of the endless loop of the first felt 4 and is pressed against a backing roll 26 about which another felt 27 passes. As this shoe press only serves to dewater the web, it is advantageous to have a felt adapted to both sides of the web. From the nip of the first shoe press 22, the web is transferred onto the second felt 27 and, in the downstream direction of the web travel after the shoe press 22, there is located a spray applicator unit S1 for applying surface size on the web side that is opposite to the web side facing the second felt 27. From the second felt 27, the web is transferred onto a third felt 31 by means of a suction roll 28 and next in the downstream direction of the web travel there is located a spray applicator unit S2A serving to apply coating to the web surface. In the downstream direction of the web travel is next located a second shoe press 29 having a third felt 31 and a transfer belt 32 adapted to pass through its nip. The transfer belt passes over the backing roll 30 of the shoe press 29 and further over the applicator unit backing roll 33. At the applicator unit backing roll 33, to the exterior side of the endless transfer belt is adapted an applicator device S2B. Also herein, the applicator devices S2A and S2B may be operated in an alternative or complementary manner.

Figure 4:
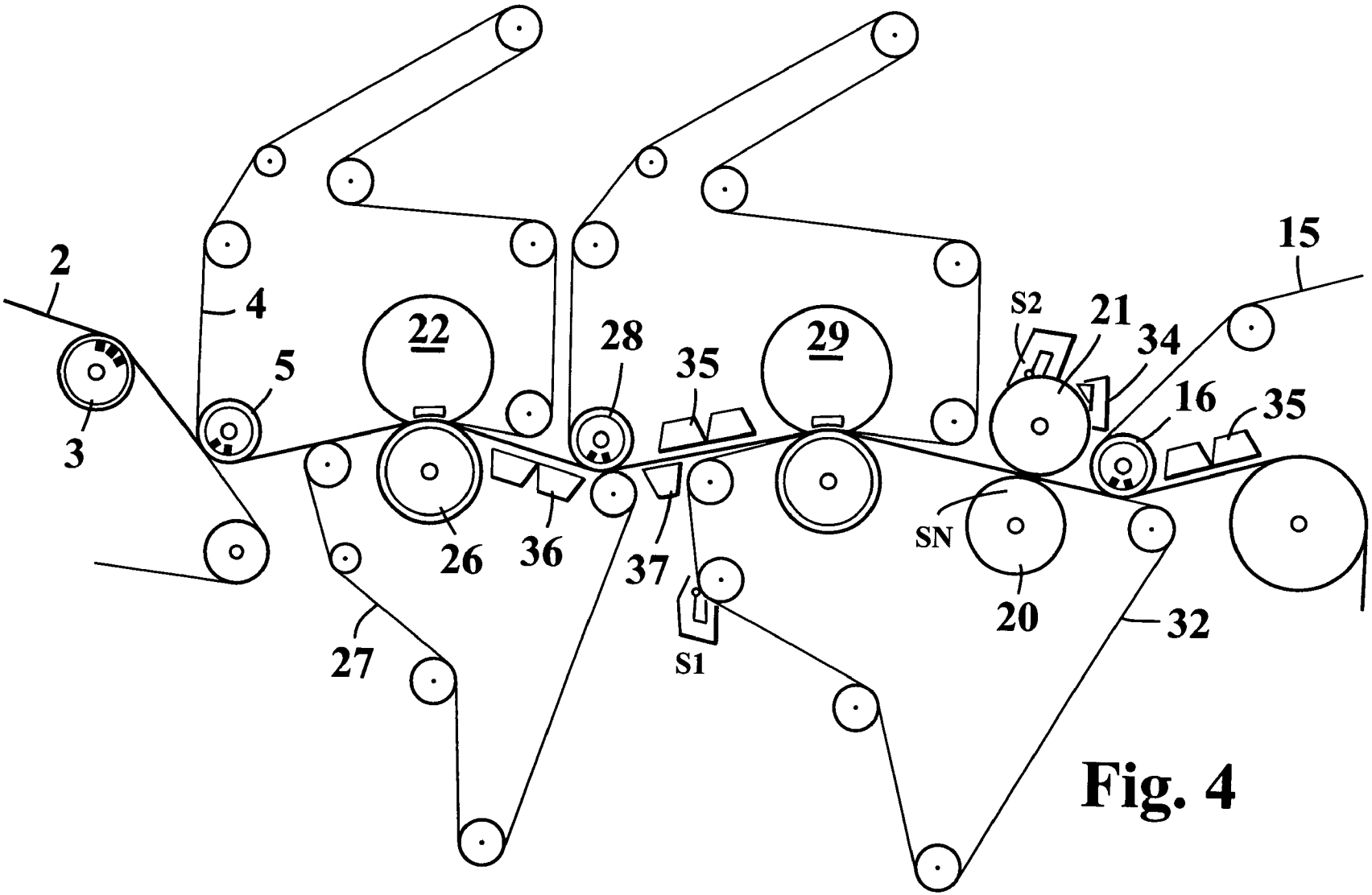
FIG. 4 shows schematically a fourth embodiment of the invention.

The embodiment shown in FIG. 4 is otherwise similar to that of FIG. 3 with the exception of a calibrating press SN which is added to the system for applying the surface size in lieu of the first press nip. Also the illustrated layout has an applicator device S2 adapted to cooperate with the roll 21 that is located on the exterior side of the calibrating press SN and, additionally, the diagram shows cleaning means 34 adapted about the exterior roll, that is, the applicator roll. Also the belt 32 may have cleaning means not shown herein. In FIG. 4 are also illustrated suction boxes 36 at the points where the web is transferred onto the next felt with the help of suction boxes. The suction boxes serve to assure the adherence of the web to the felt. In the downstream direction of the web travel, prior to the second shoe press, there is adapted a blow-down box, a dryer or a measurement device designated in the diagram as unit 37. The first applicator device is adapted to cooperate with the transfer belt 32, and the other side of the web is treated on the second roll 21 of the calibrating press SN and the applicator device S2 adapted to cooperate therewith.

Figure 5:
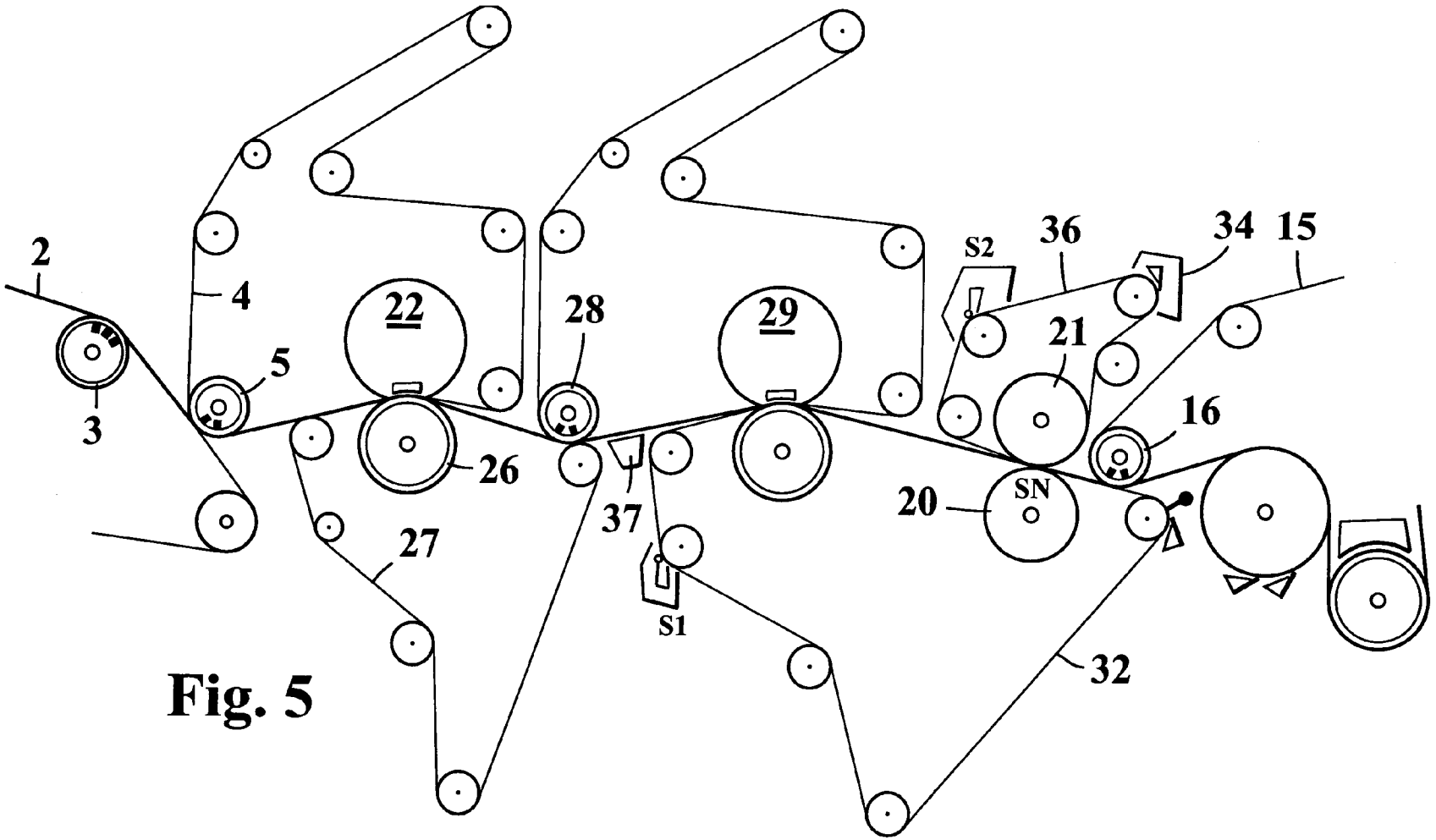
FIG. 5 shows schematically a fifth embodiment of the invention.
Figure 6:
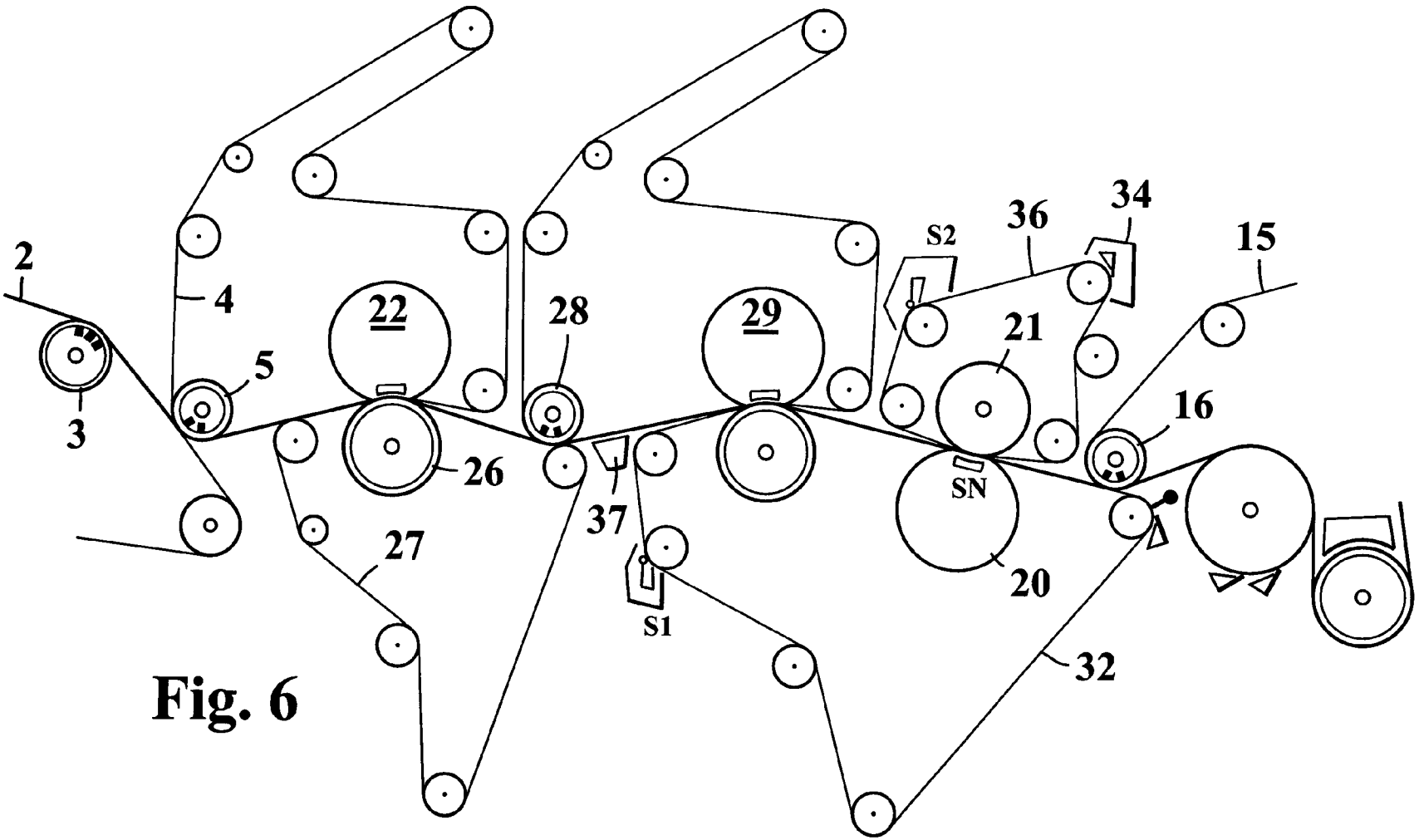
FIG. 6 shows schematically a sixth embodiment of the invention.

In the embodiment shown in FIG. 5, the calibrating press SN is complemented with the application of a treatment substance with the help of a belt 36. The applicator belt 36 moves as an endless loop about the roll of the calibrating press SN and the applicator device S2 is arranged to apply surface size to the belt. The surface size is transferred to the web surface in the calibrating press nip through which the applicator belt and the transfer belt 32 are adapted to pass. As the web passing through the nip has the applicator belt on its one side and the transfer belt on its other side, the function of the calibrating press may be controlled by a proper selection of the belt materials and, particularly, their hardness. In the embodiment shown in FIG. 6, the calendering effect has been augmented still further by using a shoe press as the calibrating press SN. The use of a shoe press also offers excellent facilities to the linear nip pressure profile control in the machine direction, thus allowing the thickness of a product being manufactured to be adjusted within a given smoothness of the web surface.

Figure 7:
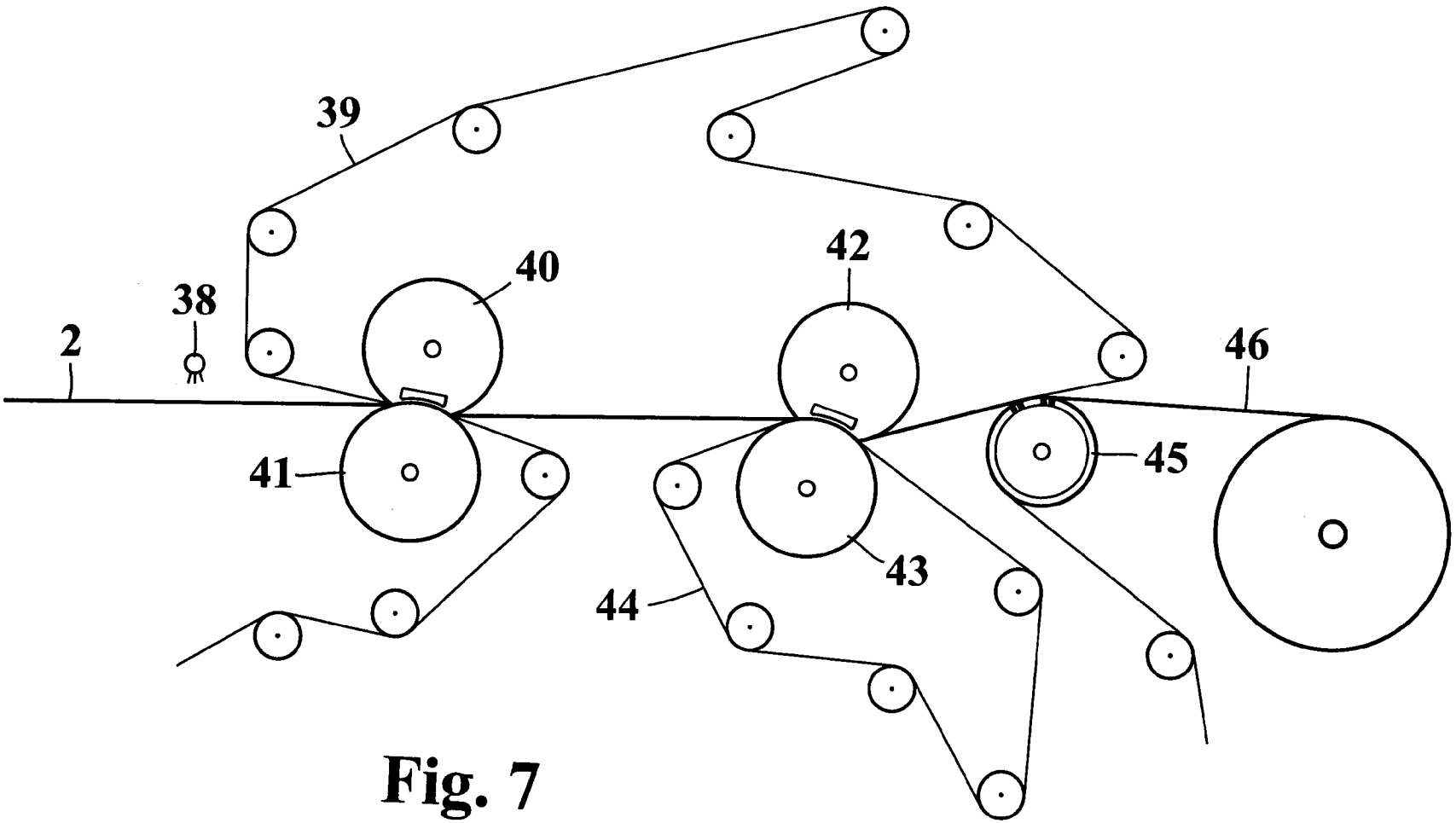
FIG. 7 shows schematically a seventh embodiment of the invention.

In FIG. 7 is shown an embodiment in which surface sizing is performed at the web-forming wire section, wherein the first dewatering step is performed. Herein, the solids content of the web is still very low. The web enters the treatment device transported by a dryer wire 2 of the paper- or boardmaking machine. On the dryer wire 2, the web is dewatered and its solids content increases. Still transported by the dryer wire, the web enters the shoe press formed by a shoe roll 40 and a backing roll 41. The dryer wire 2 passes over the backing roll 41 and the transfer belt 39 passes over the shoe roll 40. Thus, the web passes through the shoe press 40, 41 in the nip between the drying wire 2 and the transfer belt 39, whereby the water removal from the web takes place in the direction of the wire 2. In front of the nip formed between the drying wire 2 and the transfer belt 39, there is adapted a spray applicator device 38 suitable for applying a web treatment substance to the web surface. As the web strength due to its high moisture content is low before it enters the shoe press, spray application is a particularly advantageous method of application in this embodiment.

Next, the web is taken to a second press which advantageously is a shoe press as in the illustrated embodiment. The transfer belt 39 of the first shoe press 40, 41 travels over a shoe roll 42 of the second shoe press thus passing the web into the press nip. A backing roll 43 is adapted to press against the shoe roll 42 and a felt 44 passes over the backing roll 43. Also in this nip, water is removed from the web and the water removal takes place in the direction of the felt 44. Next, the web is passed supported by the transfer belt 39 onto a wire or felt 46. The web is adhered to the felt 46 with the help of a suction roll 45 mounted at the tangential meeting point of the transfer belt 39 with the felt 46. Depending on the paper or board grade to be produced, the web is next passed to a dryer cylinder group, an assembly of the kind described above for treating the other side of the web or to some other type of web treatment apparatus.

In addition to those described above, the invention may have alternative embodiments.

Obviously, the above-described embodiments may be modified in a plurality of ways. Particularly, the number and location of spray applicators may be varied as required from those illustrated herein. Instead of spray application, it is also possible to use so-called jet application, wherein a jet nozzle assembly as wide as the entire web width to be coated is used for ejecting a freely discharged jet of the treatment substance. As the jet applicator discharges the coating in a uniform jet free from droplet formation, the nuisance of coating mist formation is avoided. The jet can be directed to the surface of a belt, roll, web or directly into a nip. In the spirit of the invention, however, it is essential that a treatment substance is applied in at least one transfer-belt-supported nip to that side of a web which faces the impervious belt. Preferredly, the nip should have a impervious belt on the coated side of the web and a felt permeable to water on its other side. The pressing force in the nip may be imposed either by means of rolls or, most advantageously, using a shoe press. This kind of nip achieves efficient water removal from the web and simultaneously subjects the web surface to application or calendering.

The web treatment substance such as a coating mix or surface size may also be applied to the surface of the transfer belt using, e.g., applicator devices similar to those employed in the film-transfer application technique. E.g., the assemblies elucidated in the exemplifying embodiments may also be modified by having a plurality of surface treatment and dewatering stations arranged to operate in-line so that the transfer belt is alternately facing the opposite sides of the web. The invention is also adaptable to multilayer application, wherein at least one coating or web treatment layer is applied using the method according to the invention.

Although the technique according to the invention is most advantageously implemented without having any unsupported passages in the machinery so that the web is at all times passed supported by at least one endless loop of a support element, a roll or a cylinder, it is possible in some special arrangements to transfer the web over an unsupported passage or supporting the passage by air jets to the next support element. An air-impingement dryer, infrared dryer or the like may be used when so desired for drying the web after its treatment while the web is still travelling supported on a belt or felt, before the web enters the next nip and before the treated side of the web becomes the supported side of the web or prior to the entry of the web into the dryer section. While the composition and state of the web treatment substance do not directly affect the function of the method according to the invention, they may require the use of certain types of applicator apparatuses or changes in the physical layout of the machinery. The web treatment substance may be in the form of a liquid, solution, dispersion, emulsion or foam, or any other kind of substance which is sufficiently easy to meter and apply.

The methods according to the invention may be complemented with coat weight measurement performed while the web is still supported on the belt or wire. Obviously, measurement equipment that operate from both sides of the web are unsuitable. One applicable technique for measuring the base sheet solids content and the coat weight, for instance, is the x-ray fluorescence method when $CaCO_3$ pigments are used. Any conventional technique of basis weight and moisture content measurement may then be combined with the x-ray fluorescence method, whereby a number of quality variables can be computed from the measurement data thus obtained.

Thus, while there have been shown and described and pointed out fundamental novel features of the present invention as applied to preferred embodiments thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for treating a moving web in a paper- or board-making machine, comprising:

forming a web on a moving wire;

removing water from the web by pressing;

drying the web by at least one dryer cylinder; and subjecting the web to surface treatment by at least one technique prior to the first dryer cylinder, the surface treatment comprising applying a web treatment substance comprising surface size or coating mix in the form of a liquid, a dispersion, an emulsion or a foam, wherein the web travels supported by a transfer belt impervious to water during at least one treatment step prior to said first dryer cylinder.

2. The method of claim 1, wherein the web treatment substance is applied to a side of the web during at least one treatment step prior to the first dryer cylinder and the web is arranged to travel supported by a transfer belt so that the side of the web to which the treatment substance is applied is facing the transfer belt, whereby the treatment substance is pressed by the transfer belt onto the web.

3. The method of claim 2, wherein water is removed from the web in at least one step by pressing the web with the help of an endless felt against the transfer belt by a press element.

4. The method of claim 2, wherein the web treatment substance is applied to the surface of the transfer belt by one of a film-transfer applicator device, a spray applicator, a jet applicator, and a short-dwell applicator, whereby the treatment substance is applied to the web as a film which travels on the surface of the transfer belt.

5. The method of claim 2, wherein the web is passes through a nip formed by two transfer belts pressable against each other, wherein the web treatment substance is applied to the surfaces of both belts and the web treatment substance is subsequently transferred to both surfaces of the web.

6. The method of claim 1, further comprising calendering at least one side of the web against a transfer belt.

7. The method of claim 6, wherein water is removed from the web in at least one step by pressing the web with the help of an endless felt against the transfer belt by a press element.

8. The method of claim 1, wherein the web is subjected to a surface treatment while its solids content is in the range of 10 to 60%.

9. The method of claim 1, wherein water is removed from the web in at least one step by pressing the web with the help of an endless felt against the transfer belt by a press element.

10. The method of claim 9, wherein the web is pressed by a felt against the transfer belt in a shoe press.

11. The method of claim 9, wherein the web is pressed by a felt by pressing it against a transfer belt by a roll.

12. The method of claim 1, wherein water is removed from the web by a noncontacting dryer prior to the first dryer cylinder.

13. The method of claim 12, wherein the web is dried after application of the web treatment substance during the first treatment step by means of a noncontacting dryer.

14. The method of claim 1, wherein the web is conveyed, at least when it is dewatered, under pressing in continuous contact with at least one endless support element.

15. The method of claim 14, wherein the endless support element comprises one of a wire, a felt and a transfer belt.

16. The method of claim 14, wherein the web treatment substance is applied in at least one step directly to the web surface by a spray applicator.

17. The method according to claim 14, wherein the web treatment substance is applied directly into a nip formed between the transfer belt and the web.

18. The method of claim 14, wherein the web is dried after application of the web treatment substance during the first treatment step by means of a noncontacting dryer.

19. The method of claim 1, wherein the web treatment substance is applied to the surface of the transfer belt by one of a film-transfer applicator device, a spray applicator, a jet applicator, and a short-dwell applicator, whereby the treatment substance is applied to the web as a film which travels on the surface of the transfer belt.

20. The method of claim 19, wherein the web is dried after application of the web treatment substance during the first treatment step by means of a noncontacting dryer.

21. The method of claim 19, wherein at least two layers of the web treatment substance are applied at least to one side of the web during at least two separate web treatment steps.

22. The method of claim 19, wherein at least one layer of the web treatment substance is applied to the web by means of a film-transfer roll.

23. The method of claim 1, wherein the web treatment substance is applied in at least one step directly to the web surface by a spray applicator.

24. The method of claim 23, wherein the web is dried after application of the web treatment substance during the first treatment step by means of a noncontacting dryer.

25. The method of claim 23, wherein at least two layers of the web treatment substance are applied at least to one side of the web during at least two separate web treatment steps.

26. The method according to claim 1, wherein the web treatment substance is applied directly into a nip formed between the transfer belt and the web.

27. The method of claim 26, wherein the web treatment substance is applied to the transfer belt.

28. The method of claim 27, wherein the web treatment substance is further applied directly to the web in an amount so as to form a pond substantially where the web and the transfer belt contact.

29. The method of claim 26, wherein the web is dried after application of the web treatment substance during the first treatment step by means of a noncontacting dryer.

30. The method of claim 26, wherein at least two layers of the web treatment substance are applied at least to one side of the web during at least two separate web treatment steps.

31. The method of claim 1, wherein the web treatment substance is applied to the transfer belt.

32. The method of claim 31, wherein the web treatment substance is further applied directly to the web in an amount so as to form a pond substantially where the web and the transfer belt contact.

33. The method of claim 31, wherein the web is dried after application of the web treatment substance during the first treatment step by means of a noncontacting dryer.

34. The method of claim 31, wherein at least two layers of the web treatment substance are applied at least to one side of the web during at least two separate web treatment steps.

35. The method of claim 1, wherein the web is treated in a calibrating press prior to passing the web to the first dryer cylinder.

36. The method of claim 35, wherein the transfer belt is passes through a nip of the calibrating press.

37. The method of claim 36, wherein the web is treated in a calibrating press having a nip formed by two rolls, wherein the treatment substance is applied to one roll of the calibrating press by an applicator device and the treatment substance is subsequently transferred from the surface of the roll to the web.

38. The method of claim 36, wherein the web is treated in a calibrating press having a nip formed by two rolls and a belt running about one of said rolls, wherein the treatment substance is applied to the surface of the belt of the calibrating press by an applicator device and the treatment substance is subsequently transferred from the surface of the belt to the web.

39. The method according to claim 36, wherein the web is treated in a calibrating press having a nip formed by a roll and a shoe roll having a belt running about the roll, wherein the web treatment substance is applied to a surface of the belt of the calibrating press by an applicator device and the web treatment substance is subsequently transferred from the surface of the belt to the web.

40. The method of claim 35, wherein the web is treated in a calibrating press having a nip formed by two rolls, wherein the treatment substance is applied to one roll of the calibrating press by an applicator device and the treatment substance is subsequently transferred from the surface of the roll to the web.

41. The method of claim 35, wherein at least two layers of the web treatment substance are applied at least to one side of the web during at least two separate web treatment steps.

42. The method of claim 1, wherein the web is supported at least partially during dewatering by one of a felt, a belt, a roll, a cylinder, an air blow support means, and a vacuum support means.

43. The method of claim 42, wherein the web is dried after application of the web treatment substance during the first treatment step by means of a noncontacting dryer.

44. The method of claim 42, wherein at least two layers of the web treatment substance are applied at least to one side of the web during at least two separate web treatment steps.

45. The method of claim 1, wherein the web is dried after application of the web treatment substance during the first treatment step by means of a noncontacting dryer.

46. The method of claim 45, wherein the noncontacting dryer comprises one of a radiant heat dryer and an air-impingement dryer.

47. The method of claim 1, wherein at least two layers of the web treatment substance are applied at least to one side of the web during at least two separate web treatment steps.

48. The method of claim 47, wherein at least one layer of the web treatment substance is applied to the web by means of a film-transfer roll.

49. The method of claim 1, wherein at least one layer of the web treatment substance is applied to the web by means of a film-transfer roll.

50. The method of claim 1, wherein the web is pressed against a roll by a transfer belt.

51. An apparatus for a paper- or board-making machine comprising:

a wire section for forming a moving web of paper or board;

a dryer means for removing water from the web by pressing;

at least one dryer cylinder for drying the web;

at least one surface treatment device for treating the surface of the web prior to the first dryer cylinder, the surface treatment comprising applying a web treatment substance comprising surface size or coating mix in the form of a liquid, a dispersion, an emulsion or a foam; and at least one transfer belt that is impervious to water and that forms an endless loop against which the web is arranged to travel while the surface of the web is treated by the surface treatment device.

52. The apparatus of claim 51, wherein the treatment substance is applied to the web surface facing a transfer belt in a manner that causes the applied substance to be pressed into the web by said belt.

53. The apparatus of claim 52, wherein at least one of the surface treatment devices is a calender.

54. The apparatus of claim 52, further comprising at least one noncontacting dryer means used for drying the web prior to the first dryer cylinder.

55. The apparatus of claim 51, wherein at least one of the surface treatment devices is a calender.

56. The apparatus of claim 51, further comprising:

a felt positioned to travel against said transfer belt so that the web to be treated is passed between the felt and the transfer belt; and at least one pressing means for pressing the felt against the transfer belt for removing water from the web by pressing.

57. The apparatus of claim 56, wherein said pressing means is a shoe press.

58. The apparatus of claim 56, wherein said pressing means is a roll.

59. The apparatus of claim 51, wherein said wire section comprises a web-forming wire, and further comprising at least one felt, wire and belt, and a means for picking the web off the web-forming wire of said wire section and passing the web supported by the at least one felt, wire and belt to a next belt, felt or wire.

60. The apparatus of claim 59, further comprising a wire passing about said dryer cylinder, and a means for picking the web off said transfer belt and passing the web at least partially supported by said wire to said dryer cylinder.

61. The apparatus of claim 60, further comprising at least one felt and at least one transfer belt positioned to pass the web in a continuously supported manner and in continuous connection with said transfer belt through said dryer means.

62. The apparatus of claim 51, further comprising a means for applying the web treatment substance to a surface of the transfer belt.

63. The apparatus of claim 62, wherein said means for applying the web treatment substance to a surface of the transfer belt comprises one of a film-transfer applicator, a spray applicator, a jet applicator, and a short-dwell applicator device.

64. The apparatus of claim 62, further comprising at least one noncontacting dryer to dry the web after the application of the web treatment substance.

65. The apparatus of claim 51, further comprising at least one spray applicator device located proximate the dryer means for applying the web treatment substance to one of the web, and a nip formed by the web and the transfer belt.

66. The apparatus of claim 65, further comprising at least one noncontacting dryer to dry the web after the application of the web treatment substance.

67. The apparatus of claim 51, further comprising a calibrating press located in front of said dryer cylinder.

68. The apparatus of claim 67, wherein said transfer belt passes through the calibrating press.

69. The apparatus of claim 68, further comprising a roll located on the exterior side of said transfer belt of the calibrating press, and a means for applying the web treatment substance on said roll located on the exterior side of the endless-loop transfer belt of the calibrating press.

70. The apparatus of claim 65, further comprising at least one noncontacting dryer to dry the web after the application of the web treatment substance.

71. The apparatus of claim 68, further comprising a belt positioned to pass as an endless loop over said roll located on the exterior side of said transfer belt, and a means for applying the web treatment substance on the surface of said belt positioned to pass over said roll located on the exterior side of said transfer belt.

72. The apparatus of claim 71, wherein said calibrating press comprises a shoe press.

73. The apparatus of claim 67, further comprising a belt positioned to pass as an endless loop over said roll located on the exterior side of said transfer belt, and a means for applying the web treatment substance on the surface of said belt positioned to pass over said roll located on the exterior side of said transfer belt.

74. The apparatus of claim 73, wherein said calibrating press comprises a shoe press.

75. The apparatus of claim 51, further comprising a calender through which the web is adapted to pass prior to passing to said dryer cylinder.

76. The apparatus of claim 51, further comprising:

at least two transfer belts positioned to move at least a portion of their travel opposed to each other so that the web is passed therebetween;

a means for applying the web treatment substance to the surfaces of said transfer belts; and a means for pressing said transfer belts against each other for setting up an application pressure.

77. The apparatus of claim 76, further comprising at least one noncontacting dryer to dry the web after the application of the web treatment substance.

78. The apparatus of claim 51, further comprising at least one noncontacting dryer to dry the web after the application of the web treatment substance.

79. The apparatus of claim 51, further comprising at least one film-transfer roll for applying the web treatment substance to the web surface.

80. The apparatus of claim 51, further comprising a roll and wherein at least one transfer belt is positioned to pass over said roll such that the web is pressed by the transfer belt against the roll.

81. A method for treating a moving web in a paper- or board-making machine, comprising:

forming a web on a moving wire;

removing water from the web by pressing;

drying the web by at least one dryer cylinder; and subjecting the web to surface treatment by at least one technique prior to the first dryer cylinder, wherein the web travels supported by a transfer belt impervious to water during at least one treatment step prior to said first dryer cylinder, and wherein the web is treated in a calibrating press prior to passing the web to the first dryer cylinder.

82. The method of claim 81, wherein the transfer belt is passes through a nip of the calibrating press.

83. The method of claim 82, wherein the web is treated in a calibrating press having a nip formed by two rolls and a belt running about one of said rolls, wherein the treatment substance is applied to the surface of the belt of the calibrating press by an applicator device and the treatment substance is subsequently transferred from the surface of the belt to the web.

84. The method according to claim 82, wherein the web is treated in a calibrating press having a nip formed by a roll and a shoe roll having a belt running about the roll, wherein the treatment substance is applied to a surface of the belt of the calibrating press by an applicator device and the treatment substance is subsequently transferred from the surface of the belt to the web.

85. An apparatus for a paper- or board-making machine comprising:

a wire section for forming a moving web of paper or board;

a dryer means for removing water from the web by pressing;

at least one dryer cylinder for drying the web;

at least one surface treatment device for treating the surface of the web prior to the first dryer cylinder;

at least one transfer belt that is impervious to water and that forms an endless loop against which the web is arranged to travel while the surface of the web is treated by the surface treatment device; and a calibrating press located in front of said dryer cylinder.

86. The apparatus of claim 85, wherein said transfer belt passes through the calibrating press.

* * * * *